US009284691B2

(12) United States Patent
Petefish

(10) Patent No.: US 9,284,691 B2
(45) Date of Patent: Mar. 15, 2016

(54) PAPER PULPING PROCESS AND COMPOSITION

(71) Applicant: Friends Of Abilities First, Inc., Springfield, MO (US)

(72) Inventor: Jonathan Petefish, Springfield, MO (US)

(73) Assignee: FRIENDS OF ABILITIES FIRST, INC., Springfield, MO (US)

( * ) Notice: Subject to any disclaimer, the term of this patent is extended or adjusted under 35 U.S.C. 154(b) by 15 days.

(21) Appl. No.: 14/292,175

(22) Filed: May 30, 2014

(65) Prior Publication Data

US 2014/0352905 A1 Dec. 4, 2014

Related U.S. Application Data

(60) Provisional application No. 61/830,482, filed on Jun. 3, 2013.

(51) Int. Cl.

| | |
|---|---|
| ***D21H 21/32*** | (2006.01) |
| ***D21H 17/36*** | (2006.01) |
| ***D21H 17/67*** | (2006.01) |

(52) U.S. Cl.

CPC ..... *D21H 21/32* (2013.01); *D21H 17/36* (2013.01); *D21H 17/675* (2013.01)

(58) Field of Classification Search

USPC ..... 162/4, 10, 70, 73, 74, 87, 158, 160, 162/168.1, 175, 181.1–181.2, 185, 189

See application file for complete search history.

(56) References Cited

U.S. PATENT DOCUMENTS

| | | | | |
|---|---|---|---|---|
| 6,254,814 | B1 * | 7/2001 | Ueda et al. | 264/119 |
| 2002/0012759 | A1 * | 1/2002 | Asayama et al. | 428/34.2 |
| 2005/0236415 | A1 * | 10/2005 | Ozasa et al. | 220/912 |
| 2006/0047026 | A1 * | 3/2006 | Yamada et al. | 524/9 |
| 2006/0102305 | A1 * | 5/2006 | Xu | 162/150 |
| 2008/0222952 | A1 * | 9/2008 | Cheung et al. | 47/65.7 |
| 2009/0008819 | A1 * | 1/2009 | Ozasa et al. | 264/241 |
| 2012/0104009 | A1 * | 5/2012 | Fascio | 220/694 |

* cited by examiner

*Primary Examiner* — Dennis Cordray
(74) *Attorney, Agent, or Firm* — Lathrop & Gage LLP

(57) ABSTRACT

This is a method and composition for a paper pulp product used to create formable or moldable products from the paper pulp that cures with significant rigidity, stability and strength. The composition includes a mixture of raw paper, calcium carbonate (marble dust), starch, polyvinyl alcohol and water. Bleach may be added to create a substantially white or neutral product. The pulp composition is particularly suitable to molding and can be used to manufacture picture frames, small items of furniture and the like. The resulting product is highly suitable to art paper, arts and crafts. The process is extremely easy and results in a product that is highly adaptable for numerous uses.

9 Claims, No Drawings

PAPER PULPING PROCESS AND COMPOSITION

CROSS-REFERENCE TO RELATED APPLICATIONS

This application claims the benefit of U.S. Application Ser. No. 61/830,482 filed Jun. 3, 2013, the disclosure of which is incorporated herein by reference.

FIELD OF THE INVENTION

The present invention relates to a process for preparing a paper pulp composition wherein the pulp is readily moldable and, upon curing, is structurally rigid. More particularly, the invention relates to a process for pulping paper into a composition suitable for use as recycled paper, craft items, picture frames, crown molding, furniture and other products.

BACKGROUND OF THE INVENTION

The general concept of recycling paper is well known and a variety of methods exist for recycling paper and generating products from that paper. Generally, recycled paper lacks the structural integrity, rigidity and stability of the original paper incorporated into the recycled products. Moreover, the processes for recycling, or reclaiming, paper can be expensive and can require the use of a variety of chemicals.

It is also generally known to use wet or pulped process papers combined with an adhesive such as polyvinyl acetate based glue or a starch for a variety of purposes, for example, as arts and crafts material. These processes are generally known as "papier-mâché" processes. The resulting products are generally fragile, are unstable and will degrade over time, limited in stability by the integrity of the original paper and the effectiveness of the recycling process. Untreated, the products will develop mold and commonly will rot from the inside out. The processes heretofore known generally result in a finished product which is structurally weak, quickly degrades and is not suitable for any load bearing applications. It is common to lay the papier-mâché over a frame to lend strength to the end product or to otherwise provide supplementary supporting members to the product.

The current invention overcomes the limitations of the known processes and results in a pulped paper product that is rigid, highly stable, and has structural rigidity substantial enough to bear moderate loads. Moreover, the process is easy and inexpensive in comparison to many previously known methods for creating recycled paper products.

SUMMARY OF THE INVENTION

The present invention provides a paper pulping process which results in a recycled paper product that is stable, long-lasting and rigid enough to provide moderate load bearing capabilities. The process results in a wet slurry that is readily moldable and can be used in a variety of applications. For example, the resultant paper product can be molded into picture frames, crown molding, Christmas ornaments, candle holders, art paper, or dimensional products. The dimensional products can then be used to manufacture articles including furniture such as bookshelves, chairs, tables and the like. Moreover, the process is generally easy to perform and results in consistent and predictable end products. In one embodiment, a bleach is added to the composition primarily as a sanitizing agent to prevent molding and to decrease foul smells that can accompany the paper pulp during and after curing. Bleach can also be added so that the resultant paper pulp product is substantially neutral in color, preferably white, so that the product can be colored, painted, stained or tinted.

The inventive process and product disclosed herein was originally designed for use by organizations providing services to individuals with physical and mental limitations. The process is easy to achieve and safe to perform with highly predictable results. Recycled paper, preferably office waste, is gathered for use in the process and product. After processing, the resultant paper product can then be used for a variety of purposes. For example, in rehabilitation services or organizations providing services to those with disabilities, the resultant product can be used to make arts and crafts that can then be offered for sale. Unexpectedly, as the process described herein was derived, it became apparent that the process and product could be used in a variety of other applications as further disclosed herein.

The process generally includes combining a raw paper product, preferably recyclable paper such as newspapers, office paper and office waste materials along with marble dust, a starch, polyvinyl alcohol and water to form a slurry. As indicated, a bleach product can be added to the process to result in a neutral or white color end product. The addition of marble dust, starch and polyvinyl alcohol to the recycled paper result in a pulp product that can be molded and cured in a relatively short time. For example, the product can be troweled in to picture frame molds and then dried at approximately 90 degrees Fahrenheit over a two-day period. The resulting picture frame is rigid, can be painted, tinted or varnished.

To increase rigidity and stability of the final product a stabilizer may be added to the slurry. While several stabilizing products can be used, such as sulfonated melamine formate, the preferred stabilizer is calcium lignosulfonate.

These particular objects and advantages may apply not only to the embodiments disclosed herein, but may apply for other uses and processes as well and thus are not limited by the scope of the claims herein.

DETAILED DESCRIPTION OF THE INVENTION

The inventive process generally uses waste paper products, such as newspaper and office paper waste to create a stable pulped paper or slurry that is moldable and colorable for use in a variety of applications after it cures. Applications may include manufacturing picture frames, crown molding or other three dimensional objects by molding the slurry in prepared molds. The product can also be used to generate recycled paper for card stock and the like. Additionally, the product can be molded in to dimensional structures, such as 2×4 inch "boards" which can then be manufactured in to load bearing furniture, for example bookshelves, tables and the like.

Creating the pulp composition includes mixing raw paper product with marble dust, starch, polyvinyl alcohol and water.

Bleach can be added to the composition as a sanitizing agent to diminish the potential for the development of mold and to neutralize odor causing bacteria. Foul smells may develop during and after curing of the paper pulp without the addition of bleach. Moreover, bleach can be added so that the resultant paper slurry is neutral in color or white, if preferred. And a stabilizing agent, such as calcium lignosulfonate can be added to enhance the overall stability and strength of the finished products. The resulting end product is mold resistant and will not rot or degrade as quickly as traditional papier-mâché compositions.

The raw paper materials are collected preferably from waste newspaper and office paper waste. The paper, marble dust and dry starch are mixed together in a commercially available mixer. When combined, the polyvinyl alcohol, water and, if desired, bleach products and stabilizer are added to the dry ingredients. The mixer is covered to reduce the loss of liquid ingredients and to increase water retention throughout the mixing process. It is preferred that the composition is continuously mixed for at least two hours to achieve a complete pulp of the paper and to result in a uniform and consistent slurry of all of the ingredients. The marble dust combines with and embeds into the naturally occurring pores in the waste paper and adds to the overall strength of the end product. The starch stiffens the resulting paper pulp while the soluble polyvinyl alcohol acts as an emulsifier and binding agent to combine all of the fiber materials and adheres the calcium carbonate (marble dust) to the paper fibers.

It may be beneficial to add a stabilizing ingredient to the slurry to further strengthen the finished product. The addition of a small amount of calcium lignosulfonate decreases water in the slurry and acts as a static charge neutralizing compound to statically charged materials with loose ionic bonding, such as the calcium carbonate. Adding this product allows less water to be used but enhances workability of the slurry. Generally, the calcium lignosulfonate will comprise less than 1% by volume of the slurry. The preferred amount will be between 0.4% and 0.6% by volume.

The preferred materials include marble dust that includes approximately 99% calcium carbonate ($CaCO3$) sifted at approximately 35 mesh (500 micrometer) sieve. One such product is generally available from Mississippi Lime Company and marketed as their Calcarb AFM Athletic Field Marker Ground Calcium Carbonate. In addition to the calcium carbonate, a small amount of crystalline silica is included. The preferred pH of the product is between 8 and 9. The preferred polyvinyl alcohol is provided by Sekisui and is the PVOH 205S which is a water soluble polyvinyl alcohol. The preferred starch or amylum is the well-known polysaccharide presenting as food grade starch. The preferred bleach is a perchlorate at between 5% and 9% in solution. The preferred bleach is sodium hypochlorite provided at 8.25% reduced to the preferred 5% in solution.

It is also possible to tint or color the paper pulp prior to curing. During the step of mixing the ingredients, tinting materials such as paint, solid colors, varnishes and the like can be added so that the finished product is uniformly colored. Additional materials such as gold leaf, silver beads or other highlighting materials can be added during mixing so that the product is "decorated". This is particularly useful when the pulp is used to create picture frames, crown molding and the like.

The general formulation of the composition of the paper pulp product described herein is shown in Table 1. The preferred composition is approximately 13%-14% raw paper, approximately 26%-27% marble dust, approximately 9%-10% food grade starch, approximately 3%-4% polyvinyl alcohol and approximately 45%-47% water. If bleach is added it is added at less than 1% total solution, preferably 0.25% or less total slurry volume. If calcium lignosulfate is added as a stabilizer it will comprise between 0.4% and 0.6% of the slurry composition.

| COMPONENT | EFFECTIVE RANGE OF COMPOSITION BY VOLUME | PREFERRED COMPOSITION |
|---|---|---|
| Raw paper or paper fibers | 10%-20% by volume | 14% by volume |
| Calcium carbonate (marble dust) | 20%-30% by volume | 26% by volume |
| Starch | 5%-15% by volume | 10% by volume |
| Polyvinyl alcohol | 1%-10% by volume | 3% by volume |
| Water | 30%-60% by volume | 46.30% by volume |
| Bleach | 0.1%-2% by volume | 0.25% by volume |
| Calcium lignosulfate | 0.1%-1% by volume | .045% by volume |

The preferred composition for manufacturing the pulped paper product is as follows: 4,400 grams of raw paper, 8,400 grams calcium carbonate (marble dust), 3,200 grams food grade starch, 1,200 grams polyvinyl alcohol 205S, 70 grams of bleach at 5% perchlorate solution and 14,800 grams of water for a total composition of 32,070 grams. If the calcium lignosulfonate is added as the stabilizer, approximately 141 grams will be added to the total composition. The composition is sized to be mixed in a 4.25 cubic foot cement mixer or comparable mixer. The composition is mixed for at least two hours to achieve complete pulp of the paper with uniform blending of all of the ingredients. The resultant product is formed in to desired shapes, molds, dimensional products with the like and cured over approximately two days at approximately 90 degrees F. Of course, the amount of each component can be increased or decreased to accommodate differences in mixer size. It is also likely that the amount of water, paper, starch and calcium carbonate will need to be adjusted in differing climates and at different altitudes because the mixing process will be affected by those variables.

During the mixing process, the slurry can be further modified by adding in a variety of coloring agents, textures, paint, varnish, bleach, natural coloring agents, and highlighting materials such as glitter, gold leaf or similar products. The potential materials that can be added to the slurry to change the appearance and aesthetics of the finished product are almost endless. Moreover, the products can also be enhanced using known techniques, such as placing decorative items in a mold before adding the slurry to the mold, thereby creating decoration on incorporated only on the finished surface of the product after it is removed from the mold.

After mixing but before curing the slurry, it can be formed into a desired product by several methods. For example, picture frames can be made by placing the slurry into pre-formed molds prior to curing. Dimensional products can be made by molding or forming to slurry prior to or during curing. The structural integrity of the product is suitable to form one inch, two inch or larger dimensional products that can be cut and connected for use in applications similar to light weight wood. The finished product can further be painted, colored, varnished or otherwise treated or decorated.

It will be understood that the present process is not limited strictly to use with recycled papers or paper fibers but may also be used to provide for extremely uniform pulp for paper making processes or for manufacturing articles from the pulp. This process can be modified to use virgin paper fibers and is not limited to recycled or raw paper. It will also be understood that the disclosed composition can be modified without departing from the spirit and scope of the invention. For example, modifications may have to be made to the process to accommodate differences in altitude and climate.

It is specifically intended that the present invention not be limited to the embodiments and illustrations contained herein, but include modified forms of those embodiments including portions of the embodiments in combinations of the elements and compositions so as to come within the scope of the following claims.

What is claimed is:

1. A process for creating a paper pulp composition, comprising the steps of:

combining raw paper, calcium carbonate and starch to create a dry mix;

adding polyvinyl alcohol and water to the dry mix to create a slurry;

mixing the slurry in a mixer to create a substantially uniform pulp; and curing the pulp until dry;

adding a sanitizer to the slurry prior to mixing;

wherein the sanitizer is bleach.

2. The process of claim 1 further comprising the step of placing the pulp mixture into a mold prior to the step of curing.

3. The process of claim 1 further comprising the step of forming the pulp mixture into dimensional pieces prior to the step of curing.

4. The process of claim 1 further comprising the step of tinting the pulp during the mixing step, by adding to the mixture a tinting agent selected from the group comprising: paint, varnish, bleach, natural coloring agents, and highlighting materials.

5. The process of claim 1 further comprising the step of adding a stabilizer to the slurry prior to the step of mixing.

6. The process of claim 5 wherein the stabilizer is calcium lignosulfate.

7. A paper pulp composition comprising: from between approximately 10% and approximately 20% raw paper, from between approximately 20% and approximately 30% calcium carbonate, from between approximately 5% and approximately 15% starch, from between approximately 1% and approximately 10% polyvinyl alcohol, and from between approximately 30% and approximately 60% water.

8. The composition of claim 7 further comprising from between approximately 0.1% and approximately 2% bleach.

9. The composition of claim 7 further comprising from between approximately 0.1% and approximately 1% calcium lignosulfate.

* * * * *